United States Patent [19]

Kanter

[11] 3,954,512

[45] May 4, 1976

[54] PROTECTIVE COATING OF FERROUS BASE METAL ARTICLES

[76] Inventor: Jerome J. Kanter, 12300 Hobert Ave., Palos Park, Ill. 60464

[22] Filed: Dec. 13, 1974

[21] Appl. No.: 532,461

Related U.S. Application Data

[63] Continuation-in-part of Ser. No. 279,940, Aug. 11, 1972, Pat. No. 3,833,370, which is a continuation-in-part of Ser. No. 105,650, Jan. 11, 1971, Pat. No. 3,700,505, which is a continuation-in-part of Ser. No. 828,707, May 28, 1969, abandoned.

[52] U.S. Cl. ..... 148/6.35; 148/6.15 R; 148/6; 427/11; 427/126

[51] Int. Cl.[2] ..... C23C 7/04

[58] Field of Search ..... 148/6.35, 6.3, 6.15 R, 148/6; 427/11, 126, 343, 333

[56] References Cited

UNITED STATES PATENTS

| | | | |
|---|---|---|---|
| 3,700,505 | 10/1972 | Kanter | 148/6.35 |
| 3,883,370 | 5/1975 | Kanter | 148/6.35 |

*Primary Examiner*—Ralph S. Kendall
*Attorney, Agent, or Firm*—Henry L. Brinks

[57] ABSTRACT

Iron, steel, and iron base alloys are provided with coatings made by forming an adherent oxide layer on the surface, treating the oxide layer with at least one Group III metal, then oxidizing the Group III metal, after which the oxidized Group III metal is treated with pyrochlore-microlite mineral. The coatings are useful for providing corrosion and oxidation resistance, particularly at elevated temperatures.

18 Claims, No Drawings

PROTECTIVE COATING OF FERROUS BASE METAL ARTICLES

This application is a continuation-in-part of application Ser. No. 279,940, filed Aug. 11, 1972, now U.S. Pat. No. 3,833,370 which is a continuation-in-part of application Ser. No. 105,650, filed Jan. 11, 1971, now U.S. Pat. No. 3,700,505, which in turn is a continuation-in-part of application Ser. No. 828,707, filed May 28, 1969 now abandoned.

FIELD OF THE INVENTION

The present invention relates to coatings for ferrous base alloys, for example, to coatings containing metals selected from Group III of the Periodic Table, such as aluminum, and to processes for preparing such coatings.

BACKGROUND OF THE INVENTION

Many different types of coatings have been provided for ferrous base metals for various purposes, ranging from paints, organic compounds and enamels to electro-plated metals. Such coatings often are used for protection against corrosion, oxidation, and wear. Coatings are used to provide an electrically insulative surface.

Each known coating has characteristic advantages and disadvantages and a limited range of physical, chemical, and electrical properties. For example, some coatings are destroyed by heating to elevated temperatures. Others are water soluble. Many do not have the combination of physical, chemical and/or electrical properties desired.

SUMMARY OF THE INVENTION

It is accordingly an object of the present invention to provide unique coatings for ferrous base metal articles. It is a further object of the present invention to provide adherent coatings for ferrous base metal articles that form an electrically insulated layer thereon. It is another object of the invention to provide coatings for ferrous base metal articles that form a protective barrier on the surface thereof, as, for instance, against oxidation. It is still another object of the invention to provide a coating for ferrous base metal articles that is corrosion resistant, and particularly to a coating that effectively provides corrosion resistance at temperatures above 212°F, as encountered in boiling water and steel reactors in the electrical utility industry. It is yet another object of the invention to provide a coating that is water insoluble. It is still another object of the invention to provide a surface barrier for ferrous base metal articles. It is yet another object of the invention to provide novel coatings having a unique combination of physical, chemical and/or electrical properties. Other and further objects of the invention will be apparent from the following specification and appended claims.

DESCRIPTION OF THE PREFERRED EMBODIMENTS

The ferrous base metal articles that are to be coated may be formed of iron, steel, or ferrous base alloys. The invention is particularly applicable to carbon steels (having a carbon content from about 0.10% by weight to about 0.40% by weight), and especially to weldable carbon steels, because of their ready availability, their comparatively advantageous economic position, and their otherwise convenient maintainability.

The surface of the ferrous base metal article to be protected is formed with a tightly adherent oxide layer. The oxide layer formed by heating the article in air to temperatures in the range below the point at which the oxide layer spalls off. This is accomplished, for example, by heating the article in atmospheric oxygen to temperatures in the range from about 300°F, to about 800°F. As an alternative, the oxide layer may be formed in controlled oxidizing atmospheres. If special oxidizing atmospheres are employed, the required temperatures, of course, may be changed. As another alternative the oxide layer may be formed by exposure to the atmosphere at ambient temperatures for sufficient time to form the oxide film. In any case, temperatures and the time of oxidation are maintained at conditions sufficient to form an adherent oxide film on the metal and oxidation is discontinued prior to the formation of a loose, flaky, non-adherent film.

After the formation of the tightly adherent oxide layer, said oxide layer is treated with at least one metal in Group III of the periodic table. The Group III metal may be, for example, aluminum, scandium, yttrium, or the rare earth metals. The Group III metal is reacted in solid phase with the oxide layer. One procedure for the solid phase reaction is to frictionally contact the surface of the oxide layer with a solid form of Group III metal, as by rubbing, brushing, buffing and the like. This may be performed, for example, by frictionally rubbing a foil of the Group III metal against the oxide layer, or by applying a powder onto the oxide layer and buffing thereagainst, or by shot peening the Group III metal against the oxide layer. Another procedure is to disperse communited Group III metal particles in a hydrocarbon and to apply the dispersion to the oxide layer, after which the hydrocarbon is evaporated, and the metal buffed against the oxide layer.

In applying aluminum to the oxide layer, for example, aluminum foil may be rubbed frictionally against the oxide layer at ambient temperatures. Sufficient energy is applied in the frictional contacts during rubbing to cause a reaction between the oxide layer and the aluminum.

The Group III metal is applied in solid form to the oxide layer. Usually ambient temperatures are adequate for reaction of Group III metal in solid phase which the oxide layer, but in certain instances elevated temperatures may be desirable, and, in any event, the temperatures must be maintained in a range in which the oxide layer will not spall off by the heating. If the oxide layer is formed on the ferrous base metal by heating, it may be advantageous to apply the Group III metal prior to complete cooling of the article.

The Group III metal will be applied in solid form with the oxide layer in temperatures ranging from ambient to the point of critical transformation of the ferrous base metal article, the latter of which tends to cause the oxide layer to spall off.

Yttrium and rare earth metals desirably are reacted with the oxide layer as powders. Because the powdered forms of the yttrium and rare earth metals are pyrophoric, they are handled preferably under protective materials, for example inert hydrocarbons. The inert hydrocarbons are volatilized from the surface after the application. By way of example, after aluminum has been frictionally contacted with an oxide layer, yttrium may be applied thereto under the protection of a hydrocarbon, and then the hydrocarbon is evaporated.

The rare earth metals usually occur in mixtures, such as misch metal. They are conveniently applied, therefore, as mixtures.

Various combinations of Group III metals may be advantageous for some uses. A series of Group III metals may be reacted with the oxide layer. For example, it may be desirable first to apply aluminum, and next to apply yttrium, or misch metal to the oxide layer.

The application of the Group III metal as disclosed above results in some sort of reaction with the oxide layer not fully understood, but it is believed, for example, that aluminum forms a complex compound with the iron oxide layer. In any case, a tough adherent coating is formed. An excess of group III metal for reaction with the oxide layer is applied.

Subsequent to the application of the Group III metal to the oxide layer, the Group III in the coating is oxidized. This may be performed by treating with a phosphorus containing acidic compound. The phosphorus containing acid compounds include the phosphoric acids, such as ortho-phosphoric acid, thio-phosphoric acids, and the acid salts and/or acid esters of the foregoing. The esters may include the mono-alkyl acid phosphates, dialkyl acid phosphates, and dialkyl acid pyrophosphates. For many purposes, some of the phosphorus containing acidic compounds may be preferred to the others, and not all of the foregoing may be suitable or equally desirable for all purposes. By reason of its cost and availability, ortho-phosphoric acid is preferred for many purposes.

The phosphorus containing acidic compounds are conveniently applied by spraying on the article, or by dipping the article in a bath containing the phosphorus compound. The phosphorus containing acid compounds are believed to react with the Group III metal that has been complexed on the oxide layer to form a waterinsoluble salt.

After the treatment with phosphorus containing acid compounds, the article may be washed with water and dried.

Other oxidizing operations are contemplated, for example, treating with nitric acid, as well as other known oxidizing techniques.

The Group III metal after oxidation is then further treated as by friction processing with compositions derived from pyrochlore-microlite minerals. Pyrochlore-microlite minerals are well known columbium and tantalum containing minerals, classed as multiple oxides and made up of a mixture of oxides of more than one metallic element. One suggested chemical composition of those oxide minerals containing columbium or tantalum as a major constituent can be expressed by the general chemical formula:

$$A_mB_nO_{2(m+n)}$$

in which A contains Na and one or more additional elements, selected from the group consisting of U, Ca, Th, $Fe^2$, Mn, Zr, K, Mg, Ce, Ti, Er, Y, and La; and in which B contains at least one Group V metal selected from the class consisting of Nb and Ta, and at least one additional element selected from the group consisting of Ti, Sn, W, Zr, and $Fe^3$. The ratio of $m$ to $n$ is between 1:1 and 1:2.

It should be understood that the pyrochlore-microlite minerals are made up of an entire series of minerals. At one end of the series is pyrochlore mineral, and at the other end of the series is the microlite mineral. Pyrochlore is the columbium rich end member of the pyrochlore-microlite minerals and typically occurs associated with alkalic rocks, in pegmatites, nepheline syenite, various alkalic dike rocks, carbonatites associated with alkalic intrusions, estrusive alkalic rocks, greiesen and in decomposition products of these rocks. In fact, the alkaline character of the pyrochlore containing minerals is believed to account for the rapid increase in pH that is observed when pyrochlore is placed in a liquid medium such as water.

Microlite, on the other hand, is the tantalum-rich end member of the pyrochlore-microlite minerals. intermediate members of the pyrochlore-microlite minerals include pyrrhite, koppite, hatchettolite, chalcolamprite, endeiolite, marigacite, ellsworthite, neotantalite, and metasimpsonite. One particularly useful ore, which is known to certain pyrochlore-microlite minerals, is araxa ore.

A typical analysis of an effective fraction of pyrochlore, reciting the principal metal constituents of the mineral in the form of oxides, is as follows:

TABLE I

| Compound | Percent by Weight |
|---|---|
| $Nb_2O_5$ | 58 |
| CaO | 14.5 |
| NaO | 4 |
| FeO | 5 |
| $SiO_2$ | 0.5 |
| $TiO_2$ | 4.0 |
| Rare earth metal oxides | 4.5 |
| $PbO_2$ | 6.0 |
| $ThO_2$ | 1.5 |

Other fractions of pyrochlore may be effective, and one or more of the Group V metal constituents, in combination with one or more other of the constituents in the pyrochlore, as for example the alkali or alkaline earth metal constituents such as the sodium constituents, are in part responsible for the corrosion resistant effect on the ferrous base metal surfaces treated by the process of this invention.

It is believed that the treatment of the oxidized Group III metal layer with pyrochlore-microlite mineral compositions inherently involves some sort of interaction therebetween. It is believed that the active corrosion inhibiting agents in the pyrochlore-microlite mineral ore are the metal salts of niobium and tantalum acids, especially the alkali and alkaline salts, and particularly the alkali metal salts of such acids, for example, the alkali metal niobates and tantalates such as $NaNbO_3$, $KNbO_3$, $Na_8Ta_6O_{19}$, $NaTaO_3$. The niobic and tantalic acid radicals are known for their tendency to form complex salt and their insolubility in water. It is believed radicals of niobium and/or tantalum acids, for example, the radicals of the niobic and tantalic acids, may react with the oxidized Group III metal to form a complex salt therewith that is insoluble in water and thereby provides a surface barrier against water and steam corrosion.

The following examples set forth preferred methods of carrying out the invention. They are furnished by way of illustrations, and not as limitations to the invention.

EXAMPLE 1

The surface of a piece of carbon steel plate was oxidized by heating in air to ranges from 500°F to 700°F, to form an adherent oxide film thereon. The oxide film was rubbed with aluminum foil until an excess of aluminum was noted on the surface. The article was then dipped in a bath of technical grade concentrated phosphoric acid. The article was maintained in the phosphoric acid bath during the reaction evidenced by the formation of hydrogen gas. After the evolution of hydrogen gas had discontinued, the article was lifted from the bath, the excess phosphoric acid removed, and the article cleaned by washing with tap water, and allowed to dry.

The surface was then rubbed with pyrochlore-microlite ore by frictional contact with sufficient energy to add portions of the ore to the layer.

The article so treated was tested for its resistance to corrosion by hot water in a humidity bath over a 48 hour period. No visible corrosion was apparent.

EXAMPLE 2

A stainless steel 18-8 plate was heated to about 1300°F for 1 hour to form an oxide film on the surface. The oxide film was rubbed with aluminum foil until excess aluminum was apparent on the surface. The aluminum is then oxidized by dipping in nitric acid. The article is next dipped in water and dried. Following drying the surface is rubbed with pyrochlore-microlite ore until excess amounts of ore is apparent on the surface.

The invention lends itself to many applications. The ferrous base metal article may be first fabricated to the desired shape, such as a turbine blade, reaction vessel, or die, and then subjected to the coating process described hereinabove.

There are many unusual advantages resulting from the coating of ferrous base metal articles in accordance with the foregoing described invention.

The coating forms a water insoluble layer that resists corrosion by water and steam at elevated temperatures.

In electrical power plants the water systems are maintained at an alkaline pH. The coating described herein may be used to improve the corrosion resistance of parts used in such systems.

The coating also forms a dielectric layer or electrically insulative layer. The coating may be used to provide electrical insulation between electrical conductors.

The exact nature of the coating is not known. It is believed, however, that a succession of complexes are formed between the oxide layer, the oxidized Group III metal, and the pyrochlore-microlite ore to produce a barrier having the novel physical, chemical and/or electrical properties.

Other modes of applying the principles of the invention may be employed, change being made as regards the details described, provided the features stated in any of the following claims, or the equivalent of such, be employed.

I claim:

1. In a process for providing a coating on a ferrous base metal having an adherent oxide layer formed on a surface thereof, the steps comprising:

frictionally contacting said oxide layer of the ferrous base metal article with at least one metal in solid phase from Group III of the periodic table in order to complex said Group III metal with said oxide layer and form a coating thereon, said Group III metal selected from the class consisting of aluminum, scandium, yttrium, and the rare earth metals, oxidizing at least a portion of said Group III metal contained in said coating, and frictionally contacting said oxidized Group III metal with pyrochlore-microlite mineral materials so as to at least form a complex with the oxide of the Group III metal.

2. A process according to claim 1 in which said Group III metal comprises aluminum.

3. A process according to claim 1 in which said Group III metal comprises at least one rare earth metal.

4. A process according to claim 1 in which said Group III metal comprises yttrium.

5. A process according to claim 1 in which said oxidation step comprises treating said Group III metal with a phosphorus containing acidic compound.

6. A process according to claim 1 in which said ferrous base metal article is steel.

7. A process according to claim 1 in which said ferrous base metal article is a ferrous base alloy.

8. A process according to claim 1 in which said ferrous base metal article is a weldable carbon steel.

9. The article produced in accordance with the process of claim 1.

10. The article produced in accordance with the process of claim 2.

11. The article produced in accordance with the process of claim 3.

12. The article produced in accordance with the process of claim 4.

13. The article produced in accordance with the process of claim 5.

14. The article produced in accordance with the process of claim 6.

15. The article produced in accordance with the process of claim 7.

16. In a process for providing a coating on ferrous base metal articles, the steps comprising:

forming an adherent oxide layer on a surface of a ferrous base metal article, treating said oxide layer with at least one metal in solid form from Group III of the periodic table by frictional contacts so as to form a coating thereon, said Group III metal selected from the class consisting of aluminum, scandium, yttrium, and the rare earth metals, oxidizing at least a portion of the Group III metal contained in said coating, and treating said oxidized Group III metal layer with pyrochlore-microlite mineral materials so as to at least form a complex with the oxide of the Group III metal.

17. A process according to claim 16 in which said Group III metal comprises aluminum.

18. A process according to claim 16 in which said oxidizing step comprises treating said Group III metal with a phosphorus containing acidic compound.

* * * * *